US006136179A

United States Patent [19]

Sherwood, Jr. et al.

[11] Patent Number: 6,136,179

[45] **Date of Patent: *Oct. 24, 2000**

[54] LOW PRESSURE PROCESS FOR THE HYDROCONVERSION OF HEAVY HYDROCARBONS

[75] Inventors: David Edward Sherwood, Jr., Beaumont; Michael Kevin Porter, Cypress, both of Tex.

[73] Assignee: Texaco Inc., White Plains, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/091,610

[22] PCT Filed: Feb. 14, 1997

[86] PCT No.: PCT/US97/02409

§ 371 Date: Jun. 19, 1998

§ 102(e) Date: Jun. 19, 1998

[87] PCT Pub. No.: WO97/29841

PCT Pub. Date: Aug. 21, 1997

Related U.S. Application Data

[60] Provisional application No. 60/011,652, Feb. 14, 1996.

[51] Int. Cl.[7] ..... C10G 47/02; C10G 47/12; C10G 47/04

[52] U.S. Cl. ..... 208/109; 208/108; 208/110; 208/112; 208/111.3; 208/111.35

[58] Field of Search ..... 208/108, 110, 208/109, 112, 111.3, 111.35

[56] References Cited

U.S. PATENT DOCUMENTS

| | | | |
|---|---|---|---|
| Re. 25,770 | 4/1965 | Johanson | 208/10 |
| 2,987,465 | 6/1961 | Johanson | 208/10 |
| 3,188,286 | 6/1965 | Van Driesen | 208/108 |
| 3,630,887 | 12/1971 | Mounce et al. | 208/100 |
| 4,066,530 | 1/1978 | Aldridge et al. | 208/112 |
| 4,549,957 | 10/1985 | Hensley et al. | 208/216 |
| 4,578,181 | 3/1986 | Derouane et al. | 208/110 |
| 5,055,174 | 10/1991 | Howell et al. | 208/112 |
| 5,108,581 | 4/1992 | Aldridge et al. | 208/108 |
| 5,124,295 | 6/1992 | Nebesh et al. | 502/64 |
| 5,134,108 | 7/1992 | Deepak et al. | 502/318 |
| 5,372,705 | 12/1994 | Bhattacharya et al. | 208/112 |
| 5,397,456 | 3/1995 | Dai et al. | 208/108 |
| 5,399,259 | 3/1995 | Dai et al. | 208/216 PP |
| 5,435,908 | 7/1995 | Nelson et al. | 208/216 |

*Primary Examiner*—Walter D. Griffin
*Assistant Examiner*—Tam M. Nguyen
*Attorney, Agent, or Firm*—Morris N. Reinisch; Howrey Simon Arnold & White

[57] ABSTRACT

This invention relates to a process of catalytic hydroconversion of a heavy hydrocarbon oil containing a substantial portion of components having an atmospheric boiling point above 565° C. to give a product hydrocarbon oil containing components having a boiling point below about 565° C. The process includes steps of mixing a heavy hydrocarbon oil with an oil soluble molybdenum compound, introducing the resulting mixture into a hydroconversion zone, introducing a reactor feed gas into the hydroconversion zone, and recovering the product hydrocarbon oil from the hydroconversion zone.

19 Claims, No Drawings

LOW PRESSURE PROCESS FOR THE HYDROCONVERSION OF HEAVY HYDROCARBONS

This application claims the benefit of U.S. Provisional Application No. 60/011,652, filed on Feb. 14, 1996.

TECHNICAL FIELD OF THE INVENTION

The present invention is generally directed to an improved process for the hydroconversion or hydrocracking of heavy hydrocarbon oil feedstocks, heavy whole petroleum crude and heavy refinery residues. A stable process is achieved at reduced pressure by the inclusion of an oil soluble Group VI-B metal compound in the reactor feed. The process is preferably conducted at a total reactor pressure no greater than about 13,200 kPa (1900 psig) and preferably from about 9065 kPa (1300 psig) to about 11,822 kPa (1700 psig).

BACKGROUND INFORMATION

It is generally desired in the petroleum industry to convert heavy hydrocarbon oil, that is petroleum fractions having an atmospheric boiling point above about 565° C. (1050° F.), into lighter hydrocarbons which have higher economic value. In addition, the petroleum industry continues to desire a process that can convert heavy whole petroleum crude oil to lighter crude oil which has a substantially reduced amount of heavy hydrocarbon oil content. Other advantages sought through the treatment of heavy hydrocarbon oil, heavy whole petroleum crude oil and other similar feeds, particularly high boiling petroleum refinery residues, include hydrodesulfurization (HDS), hydrogenitrogenation (HDN), carbon residue reduction (CRR), hydrodemetallation (HDM) and sediment reduction.

Hydroconversion processes, also known and referred to herein as hydrocracking, achieve the above noted goals by reacting the feed oil with hydrogen gas in the presence of a heterogeneous transition metal catalyst. The heterogeneous transition metal catalyst is typically supported on high surface area refractory oxides such as alumina, silica, alumino-silicates, and others which should be known to one skilled in the art. Such catalyst supports have complex surface pore structure which may include pores that are relatively small in diameter (i.e. micropores) and pores that are relatively large in diameter (i.e. macropores) which effect the reaction characteristics of the catalyst. A considerable amount of research into changing the properties of hydroconversion catalysts by modifying the pore sizes, pore size distribution, pore size ratios and other aspects of the catalyst surface has resulted in the achievement of many of the aforementioned goals of hydroconversion.

An excellent example of such achievements is disclosed in U.S. Pat. No. 5,435,908 Nelson et al. in which a supported catalyst achieves good levels of hydroconversion of heavy hydrocarbon feeds to products having an atmospheric boiling point less than 538° C. (1000° F.). Simultaneously, the catalyst and process disclosed produces a liquid having an atmospheric boiling point greater than 343° C. (650° F.) with a low sediment content and a product having an atmospheric boiling point greater than 538° C. (1000° F.) having a low sulfur content. The catalyst includes a Group VIII non-noble metal oxide and a Group VI-B metal oxide supported on alumina. The alumina support is characterized as having a total Surface Area of 150–240 $m^2/g$, a Total Pore volume (TPV) of 0.7 to 0.98, and a Pore Diameter Distribution in which ≦20% of the TPV is present as primary micropores having diameters less than or equal to 100 Å, at least about 34% of the TPV is present as secondary micropores having diameters from about 100 Å to 200 Å and about 26% to 46% of the TPV is present as macropores having diameters greater than 200 Å.

Another method to substantially achieve some of the above noted goals of the hydroconversion of heavy oil feeds is disclosed in U.S. Pat. No. 5,108,581 Aldrich et al. As is disclosed by this reference, a dispersible or decomposable catalyst precursor along with hydrogen gas, preferably containing hydrogen sulfide, is added to the heavy oil feed and the mixture heated under pressure to form a catalyst concentrate. This catalyst concentrate is then added to the bulk of the heavy oil feed which is introduced into a hydroconversion reactor. Suitable conditions for the formation of the catalyst concentration include temperatures of at least 260° C. (500° F.) and elevated pressure from 170 kPa (10 psig) to 13,890 kPa (2000 psig) with exemplary conditions being 380° C. (716° F.) and 9,754 kPa (1400 psig). As is taught by the disclosure, the goal of such conditions is to decompose the catalyst precursor so as to form solid catalyst particles dispersed in the hydrocarbon oil of the catalyst concentrate before it is mixed with the bulk of the heavy feed oil in the hydroconversion reactor.

Despite such advances, the hydroconversion process of heavy hydrocarbon oil requires elevated reactor temperatures (e.g. greater than 315° C. (600° F.)) and high pressures (e.g. above 13,890 kPa (2000 psig)) of hydrogen containing gas. Due to the combination of elevated temperature and high pressures of hydrogen gas, the costs of building and operating a hydroconversion reactor are considerable. One way to reduce these costs and to improve safety of the reactor is to lower the reactor pressure. It is well known in the art that operating a hydroconversion reaction at pressures below 13,890 kPa (2000 psig)) causes the formation of intractable residues in the reactor and high levels of sediment in the product stream. The collection of residues and other sediments in the reactor and other process systems creates reactor conditions that are unpredictable and unstable. If this is to be avoided, frequent reactor shutdown and cleaning is required which causes loss of production because the reactor is not "on-line". Clearly unstable and unpredictable reaction conditions are not desirable from a product quality point of view, from a reactor operations point of view or more importantly from a safety point of view. Thus there remains an unmet need in the petroleum industry for a stable hydroconversion process for heavy hydrocarbon oil, heavy whole petroleum crude and heavy refinery residues that yield lighter hydrocarbons under pressure below 13,890 kPa (2000 psig).

DISCLOSURE OF THE INVENTION

The present invention is generally directed to an improved process for the hydroconversion or hydrocracking of heavy hydrocarbon oil feedstocks, heavy whole petroleum crude and other heavy refinery residues.

In the following disclosure, it should be understood that unless noted otherwise all boiling point values are measured at atmospheric pressure.

It is a particular feature of this invention that it permits operation to be carried out under conditions which yield a substantially decreased content of sediment in the product stream leaving the hydroconversion zone.

The charge to a hydroconversion process is typically characterized by a very low sediment content of 0.01 weight percent (wt %) maximum. Sediment is typically measured by testing a sample by the Shell Hot Filtration Solids Test (SHFST). See Jour. Inst. Pet. (1951) 37 pages 596–604 Van Kerknoort et al. incorporated herein by reference. Typical hydroprocessing processes in the art commonly yield Shell Hot Filtration Solids of above about 0.17 wt % and as high as about 1 wt % in the 343° C.+ (650° F.+) product recovered from the bottoms flash drum (BFD). Production of large amounts of sediment is undesirable in that it results in deposition in downstream units which in due course must be removed. This of course requires that the unit be shut down for an undesirable long period of time. Sediment is also undesirable in the products because it deposits on and inside various pieces of equipment downstream of the hydroprocessing unit and interferes with proper functioning of e.g. pumps, heat exchangers, fractionating tower, etc.

Very high levels of sediment formation (e.g., 1 wt % in the 343° C.+ (65° F.+) portion of the hydroprocessed product), however, are not experienced by those refiners who operate vacuum resid hydroprocessing units at stable, moderate conversion levels of feedstock components having boiling points greater than 538° C. (1000° F.) into products having boiling points less than 538% (1000% F.) (say, 40–65 volume percent—vol %—conversion).

In the instant invention the IP 375/86 test method for the determination of total sediment has been very useful. The test method is described in ASTM Designation D 4870-92-incorporated herein by reference. The IP 375/86 method was designed for the determination of total sediment in residual fuels and is very suitable for the determination of total sediment in our 343° C.+ (650° F.+) boiling point product. The 343° C.+ (650° F.+) boiling point product can be directly tested for total sediment which is designated as the "Existent IP Sediment value." We have found that the Existent IP Sediment Test gives essentially equivalent test results as the Shell Hot Filtration Solids Test described above.

As it is recommended that the IP 375/86 test method be restricted to samples containing less than or equal to about 0.4 to 0.5 wt % sediment, we reduce sample size when high sediment values are observed. This leads to fairly reproducible values for even those samples with very large sediment contents.

As the term is used herein a heavy hydrocarbon oil is a hydrocarbon oil containing a substantial amount of components having a boiling point above about 565° C. (1050° F.). Heavy hydrocarbon oils which may be utilized in the process of this invention may include high boiling petroleum cuts typified by gas oils, vacuum gas oils, coal/oil mixtures, residual oils, vacuum residue, and other similar refining residues that have a high atmospheric boiling point. An illustrative example of such a heavy hydrocarbon oil is an Arabian Medium/Heavy Vacuum Residue having the properties set forth in the first column of Table 1. Another illustrative example of a heavy hydrocarbon oil includes a mixture of a fluid cracked heavy cycle gas oil (FC HCGO) and an Arabian Medium/Heavy Vacuum residue the properties of which are given in the second column of Table 1.

TABLE 1

| Property | I | II |
|---|---|---|
| API Gravity | 4.4 | 3.1 |
| 1000° F.+, vol % | 87.3 | 76.1 |
| 1000° F.+, w % | 88.3 | — |
| 1000° F.− w % | 11.7 | — |
| Sulfur, w % | 5.8 | 5.6 |
| Total Nitrogen, wppm | 4815 | 4328 |

TABLE 1-continued

| Property | I | II |
|---|---|---|
| Hydrogen, w % | 10.10 | 9.88 |
| Carbon, w % | 83.5 | 84.10 |
| Alcor MCR, w % | 22.4 | 20.2 |
| Kinematic Viscosity, cSt | | |
| @ 200° F. | 1706 | — |
| @ 250° F. | 476 | — |
| Pour Point, ° F. | 110 | — |
| n-$C_5$ Insolubles, w % | 35.6 | 30.16 |
| n-$C_7$ Insolubles, w % | 10.97 | 9.49 |
| Toluene Insolubles, w % | 0.01 | 0.01 |
| Asphaltenes, w % | 10.96 | 9.48 |
| Metals, wppm | | |
| Ni | 44 | 37 |
| V | 141 | 118 |
| Fe | 11 | 9 |
| Sediment, wppm | Nil | Nil |

As the term is used herein, a heavy whole petroleum crude oil is a dewatered crude oil containing a substantial amount of components having a boiling point above about 565° C. (1050° F.). An example of heavy whole petroleum crude oil is Middle Eastern heavy whole petroleum crude oil some of the properties of which are summarized in Table 2 and the distillation data for which is given in Table 3.

TABLE 2

| Property | |
|---|---|
| API Gravity | 14.4 |
| Sulfur (w %) | 6.17 |
| Total Nitrogen (wppm) | 2255 |
| Pour Point (° C. (F. °)) | −25 (−14) |
| Viscosity (cst) @ 20° C. | 2045.0 |
| @ 40° C. | 429.1 |
| @ 50° C. | 229.0 |
| Neutralization Number (mg KOH/gm) | 0.55 |
| Microcarbon Residue (w %) | 12.6 |
| Vanadium (wppm) | 68 |
| Nickel (wppm) | 29 |
| Iron (wppm) | 9 |
| $C_6$'s and heavier (LV %) | 99.82 |

TABLE 3

| Fraction | Boiling Range (° C. (F. °)) | Weight % |
|---|---|---|
| Light Hydrocarbons | IBP to C4 | 0.1 |
| Light Naptha | iC5 to 82 (180) | 0.2 |
| Intermediate Naptha | 82 (180) to 130 (265) | 0.9 |
| Heavy Naptha | 130 (265) to 177 (350) | 2.2 |
| Light Kerosene | 177 (350) to 218 (425) | 3.5 |
| Heavy Kerosene | 218 (425) to 260 (500) | 4.4 |
| Atmospheric Gas Oil | 260 (500) to 343 (650) | 11.5 |
| Light Vacuum Gas Oil | 343 (650) to 454 (850) | 18.4 |
| Heavy Vacuum Gas Oil | 454 (850) to 566 (1050) | 17.2 |
| Vacuum Residue | 566 (1050) and greater | 41.6 |

The process of this invention is also useful for the hydroconversion of other refinery residues and high boiling oils which contain a majority of components boiling above 565° C. (1050° F.) thus converting them to hydrocarbon products boiling below 565° C. (1050° F.). In such cases the reactor feed may be Bottoms Flash Drum liquids which have a nominal 343° C.+ (650° F.+ boiling point, coal/oil mixtures, tar sand extracts, bottoms from deasphalting processes and other similar hydrocarbon mixtures having a boiling point of above 343° C. (650° F.). Such liquids can be generally characterized as also having undesirably high content of components boiling above 565° C. (1050° F.), sediment-formers, a high content of metals, a high sulfur content, carbon residue, and asphaltenes. Asphaltenes are herein defined as the quantity of n-heptane insolubles minus the quantity of toluene insolubles in the feedstock or product.

The present invention may be carried out in any hydroconversion zone suitable for the conditions of the improved hydroconversion reaction as is described herein. For the purposes of the present disclosure, a hydroconversion zone can be accomplished by either a slurry technique or by an expanded bed technique, also know as an ebullated bed technique. If an ebullated bed technique is used, the hydroconversion zone may contain one or more reactors which contain expanded beds of supported heterogeneous catalyst. Generally in an ebullated bed process, the bed of supported catalyst is expanded and modified by upflow of the liquid feed and hydrogen containing feed gas in the reactor at space velocities effective to provide adequate mobilization and expansion of the catalyst. Thus contact between the catalyst and the reactants is promoted without substantial carry over of the supported catalyst into the product stream. The bulk density of the supported catalyst is a factor in the selection of the catalyst from the stand point of attaining appropriate bed expansion and mobilization at effective space velocities. In practice of the process of this invention, the catalyst, preferably in the form of extruded cylinders of about 0.030 to 0.050 inch diameter and about 0.08 to 0.15 inch length may be placed within a reactor in an amount sufficient to occupy at least about 30% of the reactor void volume. Catalyst is typically withdrawn on a periodic basis and then replaced with new catalyst to maintain the proper amount of catalyst present and maintain constant catalyst activity in the reactor. Specific details of ebullated bed reactors should be known to one skilled in the art as exemplified by U.S. Pat. Nos. 4,549,957; 3,188,286; 3,630,887; 2,987,465; and Re. 25,770 the contents of which are hereby incorporated herein by reference.

The heterogeneous catalyst utilized in the process of the present invention is disclosed in detail in U.S. Pat. No. 5,435,908 the contents of which are hereby incorporated herein by reference. The catalyst support may be alumina, silica, alumino-silicates or any other conventional heterogeneous catalyst support which should be known to one skilled in the art. As is disclosed therein, alumina is the preferred support and may be alpha, beta, theta, or gamma alumina, although it is preferred to use gamma alumina. The catalyst which may be employed should be selected and characterized based on the properties of Total Surface Area (TSA), Total Pore Volume (TPV), and Pore Diameter Distribution (Pore Size Distribution PSD). The Total Surface Area should be about 150–240, preferably about 165–210. The Total Pore Volume (TPV) may be about 0.70–0.98, preferably 0.75–0.95.

The Pore Size Distribution (PSD) is such that the substrate contains primary micropores of diameter less than about 100 Å in amount less than 0.20 cc/g and preferably less than about 0.15 cc/g. Although it may be desired to decrease the volume of these primary micropores to 0 cc/g, in practice its found that the advantages of this invention may be attained when the volume of the primary micropores is about 0.04–0.16 cc/g. This corresponds to less than about 20% of TPV, preferably less than about 18% of TPV. The advantages are particularly attained at about 5–18% of TPV. It will be apparent that the figures stated for the % of TPV may vary depending on the actual TPV (in terms of cc/g). Secondary micropores having diameters in the range of about 100 Å–200 Å are present in amount as high as possible and at least about 0.33 cc/g (34% of TPV) and more preferably at least about 0.40 cc/g (50% of TPV). Although it is desirable to have the volume of secondary micropores as high as possible (up to about 74%) of the TPV, it is found that the advantages of this invention may be attained when the volume of secondary micropores is about 0.33–0.6 cc/g.

Pores having a diameter greater than 200Å are considered macropores and should be present in amount of 0.18–0.45 cc/g (26–46% of TPV) while macropores having diameters greater than 1000Å are preferably present in amount of about 0.1–0.32 cc/g (14–33% of TPV),.

It will be apparent that the catalysts of this invention are essentially bimodal: there is one major peak in the secondary micropore region of 100 Å–200 Å and a second lesser peak in the macropore region of greater than or equal to 200 Å.

The catalyst support which may be employed in practice of this invention is available commercially from catalyst suppliers or it may be prepared by variety of processes typified by that wherein about 85–90 parts of pseudobohmite silica-alumina is mixed with about 10–15 parts of recycled fines. Acids is added and the mixture is mulled and then extruded in an Auger type extruder through a die having cylindrical holes sized to yield a calcined substrate of 0.035±0.003 inch diameter. Extrudate is air-dried to a final temperature of typically about 121°–135° C. (250°–275° F.) yielding extrudates with about 20–25% of ignited solids. The air-dried extrudate is then calcined in an indirect fired kiln for about 0.5–4 hours in an atmosphere of air and steam at typically about 538°–621° C. (1000°–1150° F.).

Generally the alumina support and the finished catalysts utilized in the process of the present invention should have the characteristics and properties set forth in Table 4 wherein is should be noted that:

Column 1 lists the broad characteristics for the catalyst support including Pore Volume in cc/g and as % of TPV; Pore Volume occupied by pores falling in designated ranges—as a v % of Total Pore Volume TPV; and the Total Surface Area in $m^2/g$.

Column 2 lists the broad range of characteristics for a First Type of catalyst useful in the practice of this invention.

Column 3 lists the characteristics of a catalyst that is illustrative of a preferred catalyst used in the practice of the present invention.

Column 4 lists a broad range of characteristics for a Second Type of catalyst found to be useful in practice of the process of this invention.

TABLE 4

| | 1 | 2 | 3 | 4 |
|---|---|---|---|---|
| TPV (cc/g) | 0.7–0.98 | 0.7–0.98 | 0.87 | 0.7–0.98 |
| ≧1000 Å | 0.1–0.32 | 0.1–0.22 | 0.16 | 0.15–0.32 |
| ≧250 Å | 0.15–0.42 | 0.15–0.31 | 0.26 | 0.22–0.42 |
| ≧200 Å | 0.18–0.45 | 0.18–0.34 | 0.29 | 0.24–0.45 |
| ≦100 Å | 0.2 max | 0.15 max | 0.09 | 0.2 max |
| 100–200 | 0.33 min | 0.40 min | 0.49 | 0.33 min |
| TPV(%) | 100 | 100 | 100 | 100 |
| ≧1000 Å | 14–33 | 14–22 | 18.4 | 22–33 |
| ≧250 Å | 22–43 | 22–32 | 29.9 | 32–43 |
| ≧200 Å | 26–46 | 26–35 | 33.4 | 35–46 |
| ≦100 Å | 20 max | 15 max | 10.3 | 20 max |
| 100–200 Å | 34 min | 50 min | 56.3 | 34 min |
| Total Surface Area ($m^2/g$) | 150–240 | 155–240 | 199 | 150–210 |

At least a portion of the surface of the catalyst support is covered with metals or metal oxides to yield a product catalyst containing a Group VIII non-noble oxide in amount of 2.2 to 6 weight percent, and a Group VI-B metal oxide in amount of 7 to 24 weight percent. The Group VIII metal may be a non-noble metal such as iron, cobalt, or nickel and preferably is nickel. The Group VI-B metal may be chromium, molybdenum, or tungsten and preferably is molybdenum.

The catalysts utilized in the process of the present invention should contain no more than about 2 weight percent of $P_2O_5$ and preferably less than about 0.2 weight percent. Phosphorus-containing components should not be intentionally added during catalyst preparation because the presence of phosphorus undesirably contributes to sediment formation. Silica $SiO_2$ may be incorporated in small amounts typically up to about 2.5 weight percent.

These catalyst metals may be loaded onto the alumina support by spraying the support with a solution containing the appropriate amounts of water soluble metal compounds. The Group VIII metal may be loaded onto the alumina typically from a 10 to 50 weight percent aqueous solution of a suitable water-soluble salt such as nitrate, acetate, oxalate and other similarly suitable compounds The Group VI-B metal may be loaded onto the alumina typically from a 10 to 25 weight percent aqueous solution of a water-soluble salt such as ammonium molybdate or other suitable molybdate salts. Small amounts of $H_2O_2$ may be added to stabilize the impregnating solution. It is preferred that solutions stabilized with $H_3PO_4$ not be used in order to avoid incorporating phosphorus into the catalyst. Loading of each metal may be effected by spraying the alumina support with the aqueous solution at 15°–38° C. (60°–100° F.) followed by draining, drying at 104°–149° C. (220°–300° F.) for 2–10 hours and calcining at 482°–677° C. (900°–1250° F.) for 0.5–5 hours.

The heterogeneous catalyst may be characterized by the content of metals or metal oxides deposited on the at least part of the catalyst support surface. Such parameters are given in Table 5. It should be noted that the column numbers utilized in this table correspond to those used above in Table 4.

TABLE 5

| Metals (w %) | 1 | 2 | 3 | 4 |
|---|---|---|---|---|
| VIII | 2.2–6 | 2.5–6 | 3.1 | 2.2–6 |
| VIB | 7–24 | 13–24 | 14 | 7–24 |
| $SiO_2$ | <2.5 | <2.5 | 2 | <2 |
| $P_2O_5$ | <2 | <2 | ≦0.2 | <2 |

In the general practice of the process of this invention, a suitable amount of the heterogeneous catalyst is placed within a reactor. The feed mixture is admitted to the lower portion of the reactor which is maintained at a temperature of about 343°–454° C. (650°–850° F.), preferably about 371° C. (700° F.) to about 441° C. (825° F.). The total pressure of the reactor may be from about 6996 kPa (1000 psig) to about 24,233 kPa (3500 psig) but preferably it is maintained from about 9065 kPa (1300 psig) to about 11,822 kPa (1700 psig). The hydrogen containing feed gas is often admitted mixed with the hydrocarbon charge. Typically the hydrogen containing feed gas is introduced at a rate from about 356.2 liters ($H_2$) / liters(oil) (2000 standard cubic feet ($H_2$) / Barrel (oil)) to about 1781.2 liters ($H_2$) / liters(oil) (10,000 standard cubic feet ($H_2$) / Barrel (oil)) and preferably from about 356.2 liters ($H_2$) / liters(oil) (2000 standard cubic feet ($H_2$) / Barrel (oil)) to about 712.5 liters ($H_2$) / liters(oil) (4,000 standard cubic feet ($H_2$) / Barrel (oil)). In an ebullated bed reactor, the flow of the reaction feed mixture through the bed should be conducted at a rate from about 0.08 to 1.5 $m^3$ (oil) / $m^3$ (reactor void volume)/hour and preferably from about 0.1 to 1.0 $m^3$ (oil) / $m^3$ (reactor void volume)/hour. During operation, the bed expands to form an ebullated bed with a defined upper level. The passage of the hydrocarbon feedstock through the ebullated bed reactor converts at least a portion of the higher boiling point hydrocarbons to lower boiling products by the hydroconversion/hydrocracking reaction. Recovery of the product hydrocarbon oil which includes a substantial portion of components having a boiling point below about 565° C. (1050° F.) is effected by conventional means from the portion of the reactor above the upper level of the ebullated bed so that heterogeneous catalyst is not removed. Further conventional means such as passage through a hot separator, cold separator, pressure flash drums, atmospheric and vacuum fractionators and other conventional means allows for the separation of the different fraction of the product stream. In one embodiment, the highest boil fractions of the product stream are directed back through the hydroconversion zone as part of the hydrocarbon feed. Thus by "recycling" the higher boiling point fractions of the product back into the reaction a minimal amount of reactor waste is generated. Operation of the hydroconversion zone is essentially isothermal with a typical maximum temperature difference between the inlet and the outlet of about 0° to 27° C. (0°–50° F.), preferably from about 0° to 16° C. (0°–30° F.).

It has been unexpectedly and surprisingly found that the inclusion of a Group VI-B metal compound in the heavy hydrocarbon oil feed achieves a stable hydroconversion reaction at total pressures below 13,200 kPa (1900 psig). As previously noted, prior to the present invention, hydroconversion or hydrocracking reactions carried out under such conditions become unpredictable and unstable due to the accumulation of deposits and sediments in the reactor and the relevant process systems. In contrast it has been found that the content of such deposits and sediments are substantially reduced in the practice of the present invention. The Group VI-B metal compound should be selected so that the first decomposition temperature that is at least 222° C. (431° F.). This is substantially greater than the first decompositions temperature of other molybdenum compounds utilized in the prior art such as molybdenum naphthalate (166° C. (331° F.)) or molybdenum octoate (111° C. (231° F.)). In addition, the compound should be soluble in the heavy hydrocarbon oil feed utilized in the hydroconversion reaction.

In one embodiment of the present invention the Group VI-B metal compound is mixed with the heavy hydrocarbon oil to give a mixture having from about 0.005 to about 0.050 weight percent metal compound present in the hydroconversion reactor feed mixture. When calculated based on the amount of elemental metal, these concentrations of metal compound correspond to values of 0.001 to about 0.004 weight percent metal.

In another related embodiment the Group VI-B metal is dissolved in a portion of the heavy hydrocarbon oil to give a pre-feed mixture in which the concentration of metal compound is from about 0.02 to about 0.42 weight percent which corresponds to a concentration of about 0.004 to 0.03 of metal when calculated based on the amount of elemental metal present. This pre-feed mixture is mixed with additional hydrocarbon oil to give the final reactor feed of the heavy hydrocarbon oil and the Group VI-B metal compound having from about 0.005 to about 0.050 weight percent metal compound present which when calculated based on the amount of elemental metal, correspond to values of 0.001 to about 0.004 weight percent metal.

In yet another embodiment the Group VI-B metal compound is an oil soluble molybdenum compound. The oil soluble molybdenum compound is mixed with the heavy hydrocarbon oil to give a mixture having from about 0.005 to about 0.050 weight percent metal compound present in the hydroconversion reactor feed. These concentrations of metal compound correspond to values of 0.001 to about 0.004 weight percent when calculated based on elemental molybdenum. A commercially available molybdenum compound that has been found to be especially useful in the practice of the present invention is molybdenum LIN-ALL (TM) which is a proprietary mixture including the reaction products of molybdenum with tall oil fatty acids available from OMG Americas, Inc. of Cleveland, Ohio USA.

Therefore in view of the above, one aspect of the present invention is a process of catalytic hydroconversion of a heavy hydrocarbon oil containing a substantial portion of components having an atmospheric boiling point above about 565° C. (1050° F.) to give a product hydrocarbon oil containing a substantial portion of components having a boiling point below about 565° C. (1050° F.). The process includes mixing the heavy hydrocarbon oil with an oil soluble molybdenum compound, to give a mixture having from about 0.005 to about 0.050 weight percent molybdenum compound. In one embodiment this may be achieved by mixing a first portion of the heavy hydrocarbon oil with the soluble molybdenum compound to give a pre-feed mixture in which the concentration of molybdenum compound is from about 0.02 to about 0.42 weight percent, and mixing the pre-feed mixture with additional heavy hydrocarbon oil to give a reactor feed mixture having a concentration of molybdenum compound from about 0.005 to about 0.050 weight percent. The molybdenum compound is selected so that it has a first decomposition temperature of at least 222° C. (431° F.). The mixture of heavy hydrocarbon oil and molybdenum compound is introduced into a hydroconversion zone having a temperature, from about 343° C. (650° F.) to about 454° C. (850° F.) and a total pressure from about 6996 kPa (1000 psig) to about 24,233 kPa (3500 psig). The hydroconversion zone should contain a heterogeneous catalyst which includes a Group VIII non-noble metal oxide, a Group VI-B metal oxide and no more than 2 weight percent phosphorous oxide supported on an alumina or silica-alumina support. In a sub-embodiment the Group VIII non-noble metal oxide is nickel and the Group VI-B metal oxide is molybdenum. In another sub-embodiment the catalyst support is alumina which has a Total Surface Area from about 150 to 240 $m^2/g$, a Total Pore Volume (TPV) from 0.7 to 0.98 and a pore diameter distribution such that no more than 20% of the TPV is present as primary micropores having diameters no greater than 100 Å, at least about 34% of the TPV is present as secondary micropores having diameters from about 100 to 200 Å, and from about 26% to 46% of the TPV is present as macropores having diameters of at least 200 Å. Also being introduced into the hydroconversion zone is a reactor feed gas which includes a majority of hydrogen gas, preferably at least 93% by volume of hydrogen and which is substantially free of hydrogen sulfide. The hydrogen containing feed gas is introduced at a rate from 356.2 liters ($H_2$) / liters(oil) (2000 standard cubic feet ($H_2$) / Barrel (oil)) to about 1781.2 liters ($H_2$) / liters(oil) (10,000 standard cubic feet ($H_2$) / Barrel (oil)). In one sub embodiment of this aspect of the present invention the temperature of the hydroconversion zone is from about 371° C. (700° F.) to about 441° C. (825° F.) and the total pressure is from about 9065 kPa (1300 psig) to about 11,822 kPa (1700 psig). When the hydroconversion zone is an ebullated bed reactor, the introduction of the feed mixture into the hydroconversion zone is conducted at a rate from about 0.08 to 1.5 $m^3$ (oil) / $m^3$ (reactor void volume)/hour. During the practice of any of the above noted aspects of the invention the product hydrocarbon oil is recovered by conventional means from the hydroconversion zone. The recovered product hydrocarbon oil has an API gravity uplift of greater than 10 over the API gravity of the heavy hydrocarbon oil feed sediment content. Of particular note, the sediment content of the product fraction that has a boiling point higher that 343° C. (650° F.) is substantially reduced when compared to the same product fraction resulting from the practice of the process in the absence of the molybdenum compound in particular sediment values achieved are below 1 weight percent and preferably below 0.7 weight percent.

Another aspect of the present invention is a method of hydrocracking a heavy whole petroleum crude oil having at least 40 weight percent components boiling above about 565° C. (1050° F.) to give a processed crude oil containing a majority of components boiling below about 565° C. (1050° F.). The method of this aspect comprises mixing the heavy whole petroleum crude with a oil soluble Group VI-B metal compound having a first decomposition temperature of at least 222° C. (431° F.), to give a reactor feed mixture having from about 0.005 to about 0.050 weight percent metal compound; reacting the reactor feed mixture and a hydrogen containing feed gas in an ebullated-bed reactor, and recovering the product processed crude oil by conventional means. In this aspect the reactor is at a temperature from about 343° C. (650° F.) to about 454° C. (850° F.) and at a total pressure of no greater than about 13,201 kPa (1900 psig). The ebullated bed includes a supported heterogeneous catalyst, the supported heterogeneous catalyst comprising a Group VIII non-noble metal oxide, a Group VI-B metal oxide, no more than 2 weight percent phosphorous oxide and an alumina or silica-alumina support. One facet of the present aspect is that the alumina or silica-alumina support is selected so that the resultant meals bearing catalyst has a Total Surface Area (TSA) of about 150 to 240 m2/g, and Total Pore Volume (TPV) from about 0.7 to 0.98 and a pore diameter distribution such that no more than 20% of the TPV is present as primary micropores having diameters no greater than 100 Å, at least about 34% of the TPV is present as secondary micropores having diameters from about 100 Å to about 200 Å, and from about 26% to about 46% of the TPV is present as macropores having diameters of at least 200 Å. Within another facet of this aspect of the present invention the Group VI-B metal compound in the reactor feed mixture is a molybdenum compound may be either mixed directly into the feed mixture or made by combining a first portion of the heavy whole petroleum crude oil with the oil soluble molybdenum compound to give a pre-feed mixture in which the concentration of molybdenum compound is from about 0.020 to about 0.420 weight percent, and mixing the pre-feed mixture with additional heavy whole petroleum crude oil to give a reactor feed mixture having a concentration of molybdenum compound from about 0.005 to about 0.050 weight percent. The recovered processed crude oil resulting from the practice of the present aspect of the invention has an API gravity uplift of greater than 10 over the API gravity of the heavy whole petroleum crude oil. In addition the processed crude oil has a decreased amount of sediment in the portion of the processed heavy crude oil having a boiling point above about 343° C. (650°

F.) as compared with the same product resulting from the process conducted without the molybdenum compound in the reactor feed mixture.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

In the following examples the heavy hydrocarbon oil feedstock was a Mid-Eastern Heavy Whole Crude oil straight out of the ground with no other treatment except dewatering, before introduction to the process of the instant invention. Properties of the Mid-Eastern Heavy Whole crude oil are given above in Tables 2 and 3.

EXAMPLE 1

An ebullated bed pilot unit was charged with heterogeneous catalyst having the properties of Column 3 in Tables 4 and 5. The heavy hydrocarbon oil feed was admitted in the liquid phase at 2515 psig to the ebullated bed pilot unit with an overall liquid space velocity (LHSV) of 0.54 per hour and an overall average temperature of 415° C. (780° F.) to maintain the reactor conditions. Hydrogen containing feed gas containing at least 93% by volume hydrogen and substantially free of hydrogen sulfide is mixed with the oil feed in an amount of 623 liters ($H_2$) / liters(oil) (3500 standard cubic feet(gas) / barrel (oil)). During the course of the experiment the hydroconversion zone of the ebullated bed pilot unit was maintained at a temperature of about 415° C. (780° F.). The through-put ratio for the reaction was about 1.0. The through-put ratio is defined as the ratio of the volumetric reactor feed rate, including recycle, to the volumetric fresh feed rate The total pressure of the hydroconversion zone was decreased until the reaction became unstable.

A sample of the results are given in below in Table 6 along with the properties of the reaction product from each pilot run. It should be noted that the values for each run were taken approximately seven days after the change in total pressure so as to allow the reaction to stabilize. The values for run 3419 are given in brackets because the run at 1700 psig were unstable after the seven day stabilization period. With regard to Table 6 it should be noted that: the values for the change in the API gravity are relative to the API gravity of the hydrocarbon oil feed; the value for conversion is the percent decrease in the volume of the fraction boiling above 538° C. (1000° F.) of the hydrocarbon feed; the abbreviation BFD refers to the Bottoms Flash Drum fraction of the product hydrocarbon which has a nominal boiling point of greater than 343° C. (650° F.) and TLP refers to the Total Liquid Product recovered from the hydroconversion zone.

TABLE 6

| Run No. | 3407 | 3411 | 3413 | 3416 | 3419 |
|---|---|---|---|---|---|
| Total Pressure, kPa (psig) | 17,338 (2500) | 15,959 (2300) | 14,378 (2100) | 13,201 (1900) | [11,822] [(1700)] |
| Inlet $H_2$ Partial Pressure (psig) | 2325 | 2139 | 1953 | 1767 | [1581] |

TABLE 6-continued

| Run No. | 3407 | 3411 | 3413 | 3416 | 3419 |
|---|---|---|---|---|---|
| Metered $H_2$ Consumption, 1 ($H_2$)/1 (oil) (SCF/Bbl) | 183 (1030) | 167 (939) | 158 (887) | 136 (765) | — — |
| Properties of Product | | | | | |
| Change in API gravity | +12.5 | +12.1 | +11.8 | +10.7 | — |
| Conversion (vol %) | 56.8 | 57.8 | 54.9 | 53.5 | — |
| BFD sediment (wt %) | 0.13 | 0.21 | 0.16 | 0.23 | [1.46] |
| TLP sediment (wt %) | 0.66 | 0.93 | 0.86 | 1.75 | [1.61] |

Given the above data, one of ordinary skill in the art should notice that as the pressure of the reaction decreases, the amount of sediment present in both the BFD fraction and the TLP increases. This increase in sediment is believed to be due to the incomplete conversion of large molecular weight hydrocarbons present in the hydrocarbon feed. One skilled in the art should also appreciate that the sediment values of run 3419 are substantially higher than is typically considered acceptable in the practice of the hydroconversion process which are typically below 1.0 weight percent and preferably below 0.7 weight percent.

The instability of the hydroconversion reaction at 1700 psig total pressure, as noted above for run 3417 is further supported by the data shown below in Table 7 which gives a detailed look at the sedimentation problem encountered. With reference to Table 7 it should be noted that the values given are for reactions that have "lined-out" that is to say the parameters have become stable. It should further be noted that: VBR means Vacuum Bottoms Recycle which is a process in which the fraction of the product stream that has a boil point greater than about 538° C. (1000° F.) is reintroduced into the hydroconversion zone as a portion of the hydrocarbon feed. This technique is conventionally used to reduce the sediment content of the hydrocarbon product.

TABLE 7

| Run No. | 3420 | 3424 | 3426 |
|---|---|---|---|
| VBR | Yes | Yes | No |
| BFD Sediment (wt %) | 0.18 | 2.4 | 4.1 |
| TLP Sediment (wt %) | 1.55 | 1.57 | — |

In view of the above, one skilled in the art should appreciate that the level of sediment rapidly increases when the hydroconversion zone is operated at a total pressure of 11,822 kPa(1700 psig). The use of vacuum bottoms recycling did not reduce the sediment content under these hydroconversion conditions. Once VBR was stopped the sediment content rapidly reached unacceptably high levels which is considered an unstable condition.

EXAMPLE 2

In this example the ebullated bed reactor utilized above in Example 1 was used. Molybdenum LIN-ALL(TM) available from OMG Americas, Inc. of Cleveland Ohio USA was mixed and introduced into the hydroconversion zone via the purge oil system through the catalyst withdrawal tube. The concentration of the molybdenum compound was about 1500 parts per million by weight of the purge oil which corresponds to approximately 220 parts per million by weight of metal. The purge oil stream was heated to about 200°–250° F. just prior to injection into the hydroconversion zone. The purge oil stream represent 13.6% of the fresh feed going to the unit. As noted in Table 8 below, this is considered injection method A. A sample of the properties of the reaction product are given in below in Table 8. It should be noted that the values for each run were taken approximately seven days after the first introduction of molybdenum compound so as to allow the reaction to stabilize.

TABLE 8

| Run No. | 3429 | 3432 | 3435 |
|---|---|---|---|
| Injection Method | A | B | B |
| Total Pressure, kPa (psig) | 11,822 (1700) | (1500) | (1300) |
| Inlet $H_2$ Partial Pressure (psig) | 2325 | 2139 | 1953 |
| Metered $H_2$ Consumption, 1 ($H_2$)/1 (oil) (SCF/Bbl) | 183 (1030) | 167 (939) | 158 (887) |
| Properties of Product | | | |
| Change in API gravity | +10.8 | +10.6 | +10.2 |
| Conversion (vol %) | 49.6 | 50.3 | 53.5 |
| BFD sediment (wt %) | 0.29 | 0.37 | 0.56 |
| TLP sediment (wt %) | 0.63 | n/a | 1.28 |

In view of the above results one of ordinary skill in the art should appreciate that the introduction of the molybdenum compound into the hydroconversion zone substantially reduces the sediment content of the hydrocarbon product stream. It should be appreciated by one of skill in the art that the sediment values of the product stream have a direct effect on the long term operation of the hydroconversion reactor. As previously noted high BFD sediment values (i.e. above about 1.0 wt %) are undesirable.

EXAMPLE 3

In this example the ebullated bed reactor utilized above in Example 2 was used. Molybdenum LIN-ALL(TM) available from OMG Americas, Inc. of Cleveland Ohio USA was mixed introduced into the hydroconversion zone along with the hydrocarbon feed. The mixture of the hydrocarbon feed and the molybdenum compound was carried out through the flush oil pump in the fresh feed system. The concentration of molybdenum LIN-ALL was approximately 902 parts per million by weight which corresponds to 132 parts per million metal. This stream represented 22.7% of the fresh feed into the reactor. The hydrocarbon feed was mixed with the hydrogen feed gas and passed through the feed heater where the combined feed was heated to about 11° C. (20° F.) above the reactor temperature. The residence time of the combined feed in the feed heater is estimated to be approximately 52 seconds at a total reactor pressure of 11,822 kPa (1700 psig) and about 40 seconds at about 1300 psig. The heated combined feed was then introduced into the hydroconversion zone of the reactor. As noted in Table 8 above, this method of introduction of the molybdenum LIN-ALL (TM) is considered injection method B. A sample of the properties of the reaction product are given in above in Table 8. It should be noted that the values for the run were taken approximately seven days after the first introduction of molybdenum compound so as to allow the reaction to stabilize. In particular the present invention allows for the operation of hydroconversion at pressures less than 1700 psig and as shown above as low as 1300 psig. This is in contrast to conventional conditions which are typically 2500 psig or greater.

While the compositions and methods of this invention have been described in terms of preferred embodiments, it will be apparent to those of skill in the art that variations may be applied to the process described herein without departing from the concept, spirit and scope of the invention. Other advantages of the present invention will be realized in the practice of the present invention and appreciated by one of skill in the art. All such similar substitutions and modifications apparent to those skilled in the art are deemed to be within the spirit, scope and concept of the invention as it is set out in the following claims.

What is claimed is:

1. A process of catalytic hydroconversion of a heavy hydrocarbon oil containing a substantial portion of components having am atmospheric boiling point above about 565° C. (1059° F.) to give a product hydrocarbon oil containing a substantial portion of components having a boiling point below about 565° C. (1050° F.), the process comprising:

mixing the heavy hydrocarbon oil with an oil soluble molybdenum compound, wherein the molybdenum compound has a first decomposition temperature of at least 222° C. (431° F.), to give a mixture having from about 0.005 to about 0.050 weight percent molybdenum compound, wherein said mixture consists essentially of the heavy hydrocarbon oil and the oil soluble molybdenum compound;

introducing the mixture into a hydroconversion zone, the hydroconversion zone being at a temperature from about 343° C. (650° F.) to about 454° C. (850° F.) and a total pressure from about 6996 kPa (1000 psig) to about 24,233 kPa (3500 psig) and containing heterogeneous catalyst, the catalyst including a Group VIII non-noble metal oxide, and a Group VI-B metal oxide on an alumia or silica-alumina support;

introducing a reactor feed gas into The hydroconversion zone, the reactor feed gas including a majority of hydrogen gas, the introducing being conducted at a rate from 356.2 liters ($H_2$) / liters(oil) (2000 standard cubic feet ($H_2$) / Barrel (oil)) to about 1781.2 liters ($H_2$) / liters(oil) (10,000 standard cubic feet ($H_2$) / Barrel (oil)); and, recovering the product hydrocarbon oil from the hydroconversion zone.

2. The process of claim 1 wherein the Group VIII non-noble metal oxide is nickel oxide and the Group VI-B metal oxide is molybdenum oxide.

3. The process of claim 1 wherein the alumina or silica-alumina has a Total Surface Area from about 150 to 240 $m^2/g$, a Total Pore Volume (TPV) from 0.7 to 0.98 and a pore diameter distribution such that no more than 20% of the TPV is present as primary micropores having diameters no greater than 100 Å, at least about 34% of the TPV is present as secondary micropores having diameters from about 100 to 200 Å, and from about 26% to 46% of the TPV is present as macropores having diameters of at least 200 Å.

4. The process of claim 1 wherein the reactor feed gas contains at least 93% by volume of hydrogen and is substantially free of hydrogen sulfide.

5. The process of claim 4 wherein the reactor feed gas is introduced at a rate from about 356.2 liters ($H_2$) / liters(oil) (2000 standard cubic feet ($H_2$) / Barrel (oil)) to about 712.5 liters ($H_2$) /liters(oil) (4,000 standard cubic feet ($H_2$) / Barrel (oil)).

6. The process of claim 1 wherein the temperature of the hydroconversion zone is from about 371° C. (700° F.) to about 441° C. (825° F.) and the total pressure is from about 9065 kPa (1300 psig) to about 11,822 kPa (1700 psig).

7. The process of claim 1 wherein the mixing of the heavy hydrocarbon oil with an oil soluble molybdenum compound includes mixing a first portion of the heavy hydrocarbon oil with the soluble molybdenum compound to give a pre-feed mixture in which the concentration of molybdenum compound is from about 0.02 to about 0.42 weight percent, and mixing said pre-feed mixture with additional heavy hydrocarbon oil to give a reactor feed mixture having a concentration of molybdenum compound from about 0.005 to about 0.050 weight percent.

8. The process of claim 1 wherein the recovered product hydrocarbon oil has an API gravity uplift of greater than 10 over the API gravity of the heavy hydrocarbon oil feed.

9. The process of claim 1 wherein the hydroconversion zone is an ebullated bed reactor and the introducing of the mixture into the hydroconversion zone is conducted at a rate from about 0.08 to 1.5 $m^3$ (oil) / $m^3$ (reactor void volume)/ hour.

10. A method of hydrocracking a heavy whole petroleum crude oil having at least 40 weight percent components boiling above about 565° C. (1050° F.) to give a processed crude oil containing a majority of components boiling below about 565° C. (1050° F.), the process comprising:

mixing the heavy whole petroleum crude with a oil soluble Group VI-B metal compound, the metal compound having a first decomposition temperature of at least 222° C. (431° F.), to give a reactor feed mixture having from about 0.005 to about 0.050 weight percent metal, wherein said reactor feed mixture consists essentially of the heavy whole petroleum crude and the oil soluble group VI-B metal compound;

reacting the mixture and a hydrogen containing feed gas in an ebullated-bed reactor, the reactor being at a temperature from about 343° C. (650° F.) to about 454° C. (850° F.) and at a total pressure of no greater than about 13,201 kPa (1900 psig) and wherein the ebullated bed includes a supported heterogeneous catalyst the supported heterogeneous catalyst comprising a Group VIII non-noble metal oxide, a Group VI-B metal oxides no more than 2 weight percent phosphorous oxide and an alumina or silica-alumina support; and, recovering the processed crude oil from the reactor.

11. The method of claim 10 wherein the Group VI-B metal compound in the reactor feed mixture is a molybdenum containing.

12. The method of claim 11 wherein the hydrogen containing feed gas includes a majority of hydrogen gas and is substantially free of hydrogen sulfide, and wherein the gas introduction is conducted at a rate from 356.2 liters ($H_2$) / liters(oil) (2000 standard cubic feet ($H_2$) / Barrel (oil)) to about 1781.2 liters ($H_2$) / liters(oil) (10,000 standard cubic feet ($H_2$) / Barrel (oil)).

13. The method of claim 12 wherein the mixing of the heavy whole petroleum crude oil with an oil soluble molybdenum compound comprises combining a first portion of the heavy whole petroleum crude oil with the oil soluble molybdenum compound to give a pre-feed mixture in which the concentration of molybdenum compound is from about 0.020 to about 0.420 weight percent, and mixing said pre-feed mixture with additional heavy whole petroleum crude oil to give a reactor feed mixture having a concentration of molybdenum compound from about 0.005 to about 0.050 weight percent.

14. The method of claim 13 wherein the reactor feed mixture and the hydrogen containing feed gas are introduced into the ebullated-bed reactor at a rate from about 0.08 to about 1.5 $m^3$(oil)$m^3$(reactor void volume)/hour.

15. The method of claim 14 wherein the temperature of the reactor is from about 371° C. (700° F.) to about 441° C. (825° F.) and the total pressure is from about 9065 kPa (1300 psig) to about 11,822 kPa (1700 psig).

16. The method of claim 15 wherein the alumina or silica-alumina support has a Total Surface Area (TSA) of about 150 to 240 $m^2$/g, and Total Pore Volume (TPV) from about 0.7 to 0.98 and a pore diameter distribution such that no more than 20% of the TPV is present as primary micropores having diameters no greater than 100 Å, at least about 34% of the TPV is present as secondary micropores having diameters from about 100 Å to about 200 Å, and from about 26% to about 46% of the TPV is present as macropores having diameters of at least 200 Å.

17. The method of claim 16 further comprising combining the reactor feed mixture with hydrogen containing feed gas at a pressure no more than about 205 kPa (15 psig) above the reactor pressure, pre-heating the pressurized reactor feed mixture in a reactor feed heater to a temperature no greater than 11° C. (20° F.) above the reactor temperature immediately before introducing the preheated, pressurized reactor feed into the reactor.

18. The method of claim 17 wherein the recovered processed crude oil has an API gravity uplift of greater than 10 over the API gravity of the heavy whole petroleum crude oil.

19. The method of claim 10 wherein the processed crude oil has a decreased amount of sediment in the portion of the processed heavy crude oil having a boiling point above about 343° C. (650° F.) as compared with the same product resulting from the process conducted without the molybdenum compound in the reactor feed mixture.

* * * * *

UNITED STATES PATENT AND TRADEMARK OFFICE

CERTIFICATE OF CORRECTION

PATENT NO. : 6,136,179

DATED : October 24, 2000

INVENTOR(S) : David Edward Sherwood, Jr. and Michael Kevin Porter

It is certified that error appears in the above-identified patent and that said Letters Patent is hereby corrected as shown below:

In column 3, line 6, please delete (65° F.+) and insert -- (650° F.+) --.

In column 14, line13, please delete (1059° F.) and insert – (1050 F.) --.

Signed and Sealed this

Eighth Day of May, 2001

*Attest:*

Nicholas P. Godici

NICHOLAS P. GODICI

*Attesting Officer*

*Acting Director of the United States Patent and Trademark Office*